United States Patent [19]

Mitsuhashi et al.

[11] 3,996,541

[45] Dec. 7, 1976

[54] ELECTROMAGNETIC SWITCH

[75] Inventors: Sadayuki Mitsuhashi; Kazutoshi Wakamatsu, both of Tokyo, Japan

[73] Assignee: Nippon Electric Company, Ltd., Tokyo, Japan

[22] Filed: June 16, 1975

[21] Appl. No.: 587,530

[30] Foreign Application Priority Data

June 14, 1974 Japan ..... 49-67092

[52] U.S. Cl. ..... 335/196; 335/162; 335/199

[51] Int. Cl.[2] ..... H01H 1/06

[58] Field of Search ..... 335/162, 163, 196, 151, 335/152, 153, 154, 207, 199

[56] References Cited

UNITED STATES PATENTS

| | | | |
|---|---|---|---|
| 3,236,964 | 2/1966 | Sommer | 335/203 |
| 3,240,909 | 3/1966 | Pflanz | 335/151 |
| 3,265,825 | 8/1966 | Barton | 335/163 |
| 3,626,337 | 12/1971 | Woodhead | 335/196 |
| 3,859,612 | 1/1975 | Kashio | 335/207 |

FOREIGN PATENTS OR APPLICATIONS

| | | | |
|---|---|---|---|
| 1,501,358 | 11/1967 | France | 335/199 |

*Primary Examiner*—Harold Broome
*Attorney, Agent, or Firm*—Sughrue, Rothwell, Mion, Zinn & Macpeak

[57] ABSTRACT

An electromagnetic switch assembly having a structure adapted for integral formation of component parts and for reduction in size and production cost, including an insulating base plate having at least one through hole formed therein to serve as a cell for relay contacts. An integrated type switching device can be realized with a matrix array of such through holes and electromagnetic relays associated therewith, the relay contacts being mounted on the base plate through the medium of two groups of conductive layers formed on the opposite surfaces of the base plate and extending along the lines and rows of contact cells, respectively.

13 Claims, 13 Drawing Figures

FIG. 5
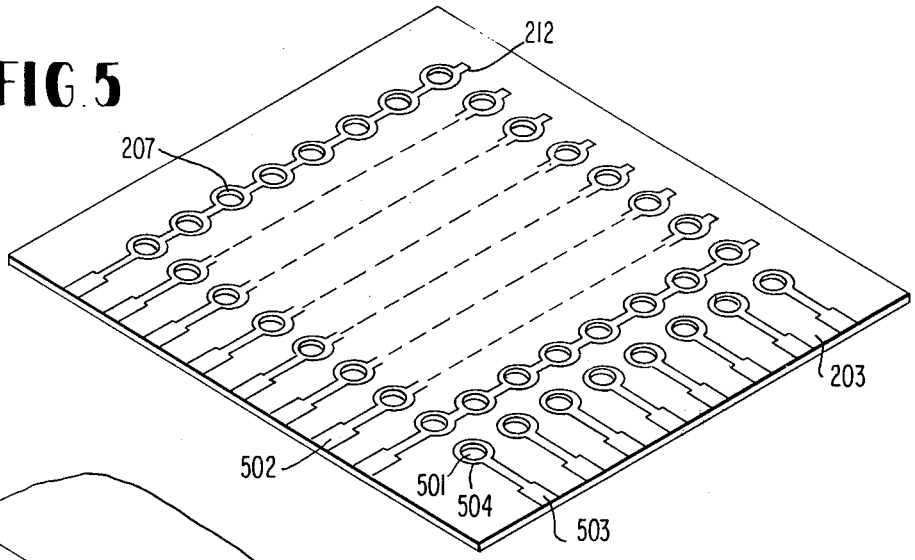
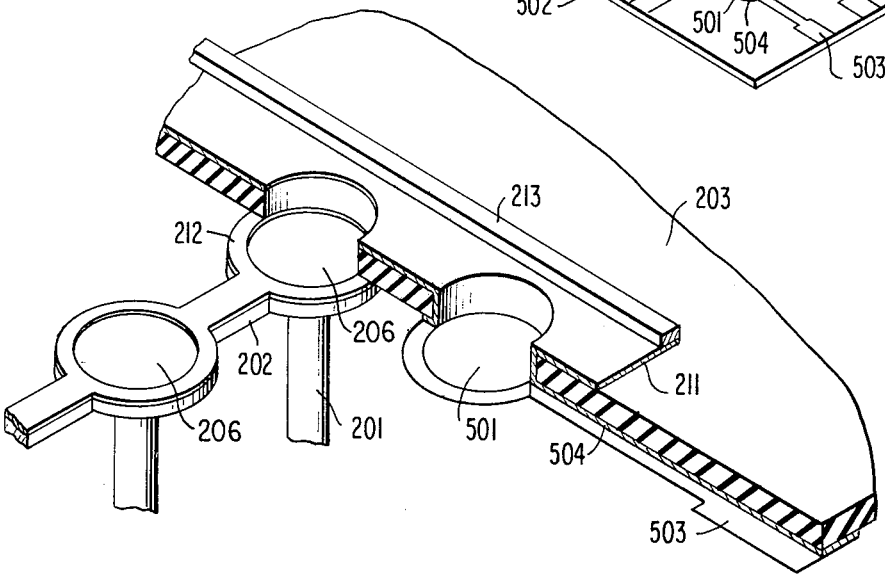
FIG. 6
FIG. 7
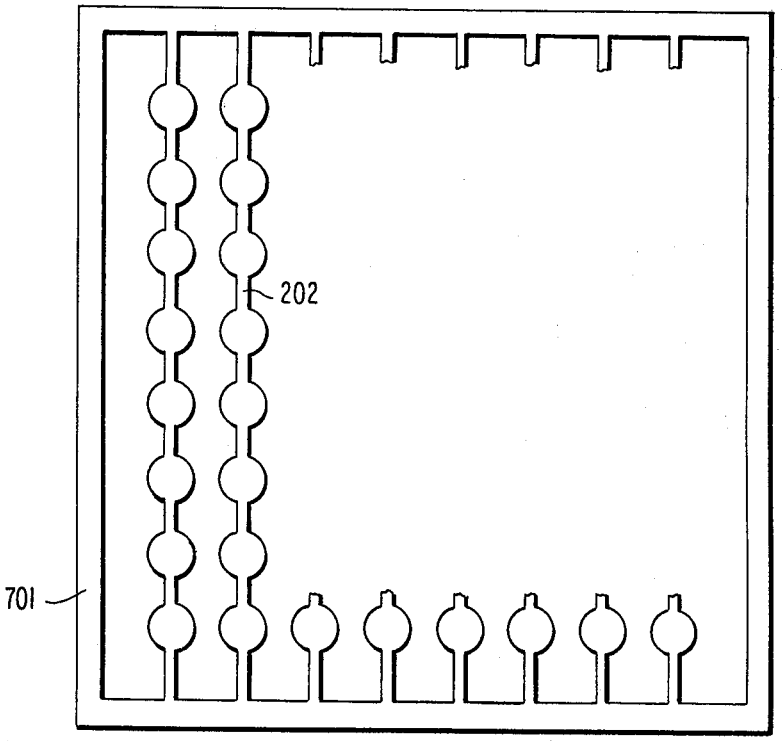

FIG. 8a
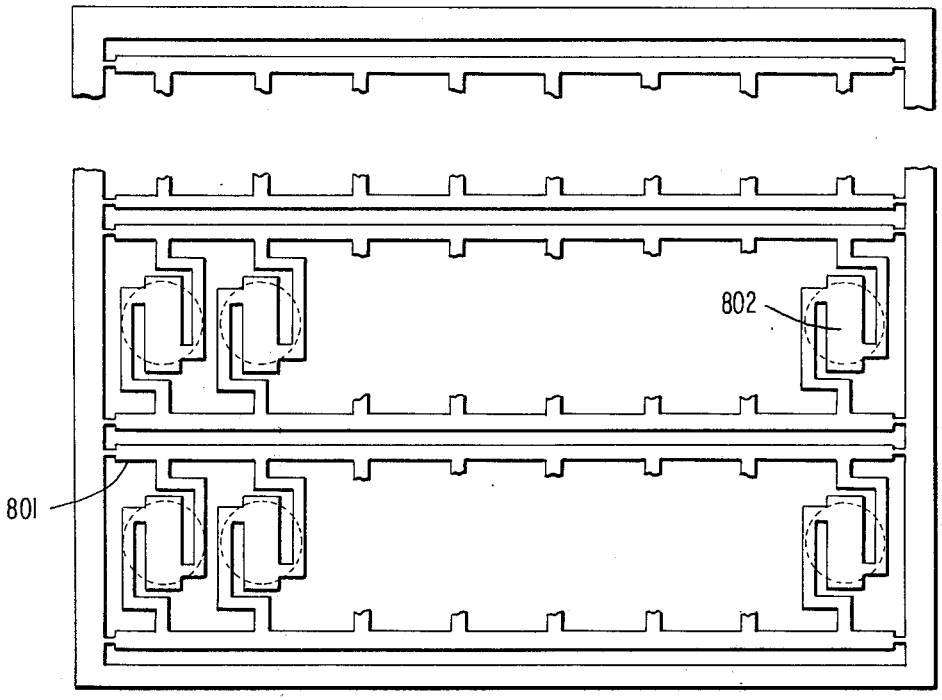
FIG. 8b
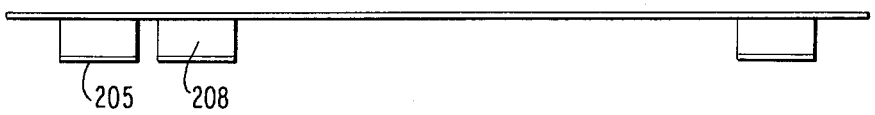
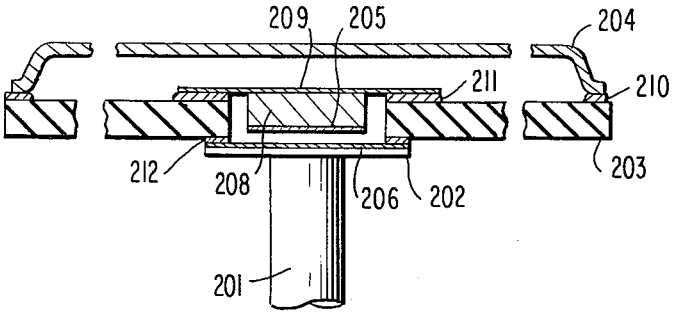
FIG. 9
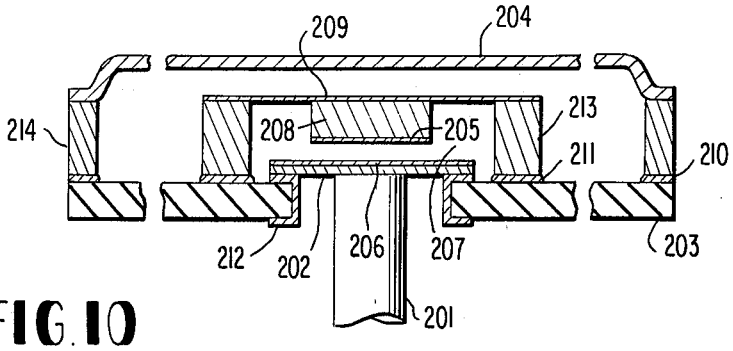
FIG. 10

ELECTROMAGNETIC SWITCH

BACKGROUND OF THE INVENTION

1. Field of the Invention

This invention relates to electromagnetic switches selectively operable under electromagnetic drive and more particularly to those of the integrated type designed for maximum component density.

2. Description of the Prior Art

Reed switches, which include a pair of contacts sealed in a glass tube or the like, have previously been known as one form of electromagnetic switch selectively operable under electromagnetic drive and are being employed in electronic switching systems of communications networks as contact elements in the speech path. In fact, in such switching systems, the capacity of the switch frame for the speech path which employ reed switches amounts to about two-thirds of all the frames required, and it has been difficult to reduce the fabrication cost of such switching systems as the switches including reed switches consisted of a large number of discrete component parts.

Further, in U.S. Pat. No. 3,150,244, issued Sept. 22, 1964, there is disclosed a multiple element type relay which includes a number of core members fixedly inserted in a metal plate perpendicular to the plane thereof through the medium of glass seals and associated with the respective switch elements of the relay. Provided on the metal plate is a cover which is connected hermetically sealed therewith and to which spring strips are welded on the inside thereof to support respective moveable contacts.

With such a switch structure, however, since the cover, serving as gas-tight sealing means, also serves as a signal line common to the moveable contacts, it is difficult to form a matrix switch including a multitude of relays and moveable contacts thereof arranged in a matrix array in which the moveable contacts are electrically connected in series, for example, by lines of the matrix so that the lines of moveable contacts may be utilized independent of each other.

Again, with the switch structure, in which the base plate is metallic and the cores themselves serve as signal lines, wiring connections of such signal lines and magnetizing coils cannot be made on the base plate and necessitates use of some additional means such as a printed circuit board provided exteriorly of the switch proper. This results in the increase in number of component parts as well as in the cost of fabrication and renders the use of such switch structure unadvisable for the realization of any high density integrated switching device.

Moreover, the switch structure, in which respective core members are inserted in the metallic base plate and fixed in position by a glass seal means, necessitates a complicated fabricating process for glass-sealing the core members, which involves the danger that the core members will be deteriorated in magnetic quality at the elevated temperatures employed.

SUMMARY OF THE INVENTION

The present invention is designed to overcome the difficulties previously encountered as described above and has for its primary object the provision of an electromagnetic switching device which is particularly adapted for high density integration, compared with previously known switch forms of the type selectively operable under electromagnetic drive.

Another object of the present invention is to provide an integrated type electromagnetic switching device which is adapted to be used with particularly high component density, employing an electrically insulating plate as a base plate on which component parts of a multitude of switch elements are assembled.

A further object of the present invention is to provide an integrated type electromagnetic switching device of the character described which includes integral formation of component parts, comprising a multitude of electromagnetic switches arranged on an electrically insulating base plate in a matrix array.

According to the present invention, there is provided an electromagnetic switch which comprises an electrically insulating plate formed with a through hole and electromagnetic relay secured to the insulating plate in a manner so that the relay contacts are arranged substantially within the through hole in the insulating plate; such structure of an electromagnetic switch can readily be made in integrated form with high component density.

According to a further aspect of the present invention, there is provided an integrated matrix type electromagnetic switching device which comprises an electrically insulating plate having a plurality of through holes formed therein in a matrix array, a first group of electrically conductive layers secured to one surface of said insulating plate and extending along the respective lines of said through holes, a second group of electrically conductive layers secured to the other surface of said insulating plate and extending along the respective rows of said through holes, and a plurality of electromagnetic relays mounted on said insulating plate in a matrix array substantially in alignment with said respective through holes and through the medium of said first and second groups of conductive layers.

BRIEF DESCRIPTION OF THE DRAWINGS

The above and other objects, features, and advantages of the present invention will become apparent from the following description when taken in conjunction with the accompanying drawings, in which:

FIGS. 4 and 5 illustrate respective patterns of metallized layers formed on the opposite surfaces of the insulating base plate in the embodiment of FIGS. 3*a*, 3*b* and 3*c;*

FIG. 6 is a fragmentary perspective view showing the configuration of contact cells formed in the embodiment of FIGS. 3*a*, 3*b* and 3*c;*

FIG. 7, FIGS. 8*a* and 8*b* illustrate respective component parts of integral formation usable in the embodiment of FIGS. 3*a*, 3*b* and 3*c*

FIG. 9 is a view similar to FIG. 2, illustrating another form of electromagnetic switch embodying the basic structure of the present invention; and FIG. 10 is a view similar to FIGS. 2 and 9, illustrating a further embodiment of the present invention.

DESCRIPTION OF THE PREFERRED EMBODIMENTS

Figure 1:
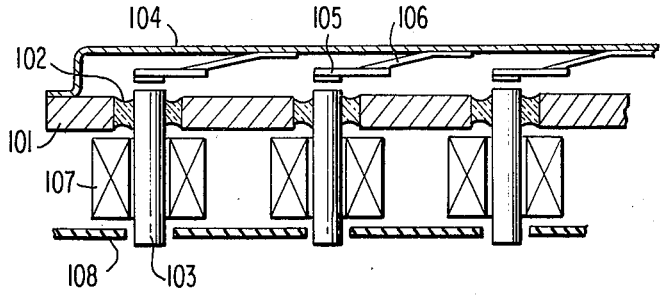
FIG. 1 PRIOR ART
FIG. 1 is a fragmentary cross-sectional view illustrating a conventional form of multiple element type electromagnetic switch.

Referring first to FIG. 1, which illustrates a typical form of conventional multiple element type electromagnetic relay, reference numeral 101 indicates a nonmagnetic metal plate in which core member 103 are each fixedly inserted perpendicular to the plane of the metal plate by a glass 102. Mounted on the metal plate 101 is a cover 104 which is connected hermetically gas-tight thereto. Spring strips or bands 106 are welded to the inside of the cover 104 each to support a relay armature 105. A magnetizing winding or coil 107 is fitted to each of core members 103 in encircling relation thereto. The core members 103 are inserted at the free end into an electrically insulating plate 108 and electrically connected in an appropriate manner.

Figure 2:
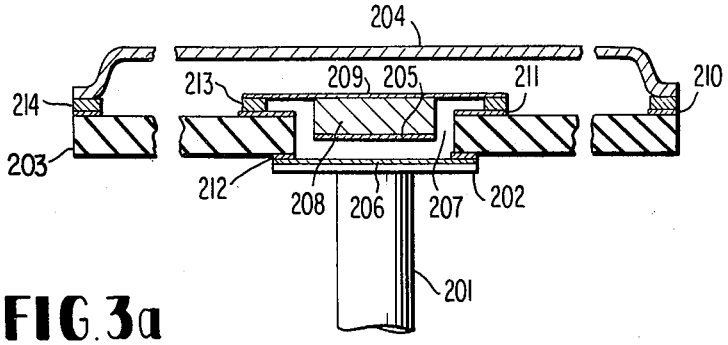
FIG. 2 is a partially broken cross-sectional view showing the structure of an electromagnetic switch embodying the present invention.
Figure 3B:
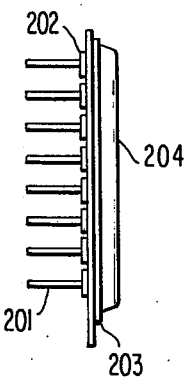
FIGS. 3*a*, 3*b* and 3*c* illustrate a further embodiment of the present invention as applied to a speech path switch, comprising an 8 by 8 matrix of contacts each of the same basic structure as that shown in FIG. 2.
Figure 3A:
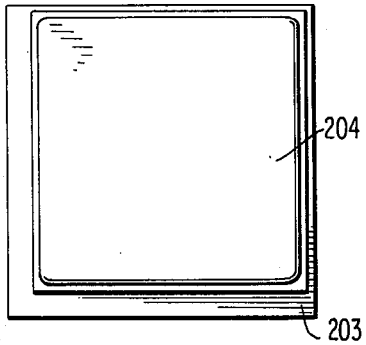
Figure 3C:
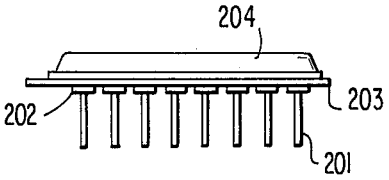

Reference will next be made to FIG. 2, which illustrates an electromagnetic switch embodying the present invention. As shown, this embodiment includes a planar electrically insulating plate 203 formed with at least one through hole 207 which serves as a contact cell, and electrically conductive thin-film layers 211 and 212 are formed on the opposite surfaces of the insulating plate 203 around the through hole 207 by metallizing, sputtering or other appropriate means. An armature 208 carrying a moveable contact 205 and sealing plate 202 carrying a stationary contact 206 are arranged in the contact cell 207 in spaced opposite relation to each other. The sealing plate 202 is secured on one side thereof to the thin-film conductive layer 212 by brazing and welded on the other side to the end face of core member 201. On the other hand, the armature 208 is secured by welding to a contact spring 209 which is brazed to support means 213, which in turn is secured to the thin-film conductive layer 211. Further, one or more such contact cells 207 are enclosed hermetically tight by a sealing cover 204 welded to a sealing ring 214, which is brazed to a metallized layer 210 formed around the periphery of the insulating plate 203 on its top side, that is, on that side on which the thin-film conductive layer 211 is formed.

In the electromagnetic switch constructed as described above, any plurality of contact cells can be selectively operated as the armatures 208 are each moveable in a direction normal to the plane of the insulating base plate 203 under magnetic attraction of the associated core member 201 as the latter is selectively magnetized. Namely, upon energization of the associated magnetizing coil (not shown), the armature 208 is attracted by the core member 201 in the direction of the longitudinal axis thereof against the resiliency of the spring 209, on which the armature is carried, so that the moveable contact 205 carried on the armature 208 is brought into contact with the stationary contact 206 and latches under the effect of remnant magnetism or is held by continued coil energization to establish the desired circuit connection. The contacts 205, 206 are opened as the contact 205 is restored to its normal position shown in FIG. 2 under the bias of spring 209, upon demagnetization of the core 201 or interruption of the coil energizing current. Incidentally, though in FIG. 2 the moveable contact 205 is shown as a piece formed separate from and secured to the armature 208, it can obviously be made as an integral part thereof, as desired.

The structure of the electromagnetic switch shown and described above is particularly suited for formation of a multitude of switching contacts, for example, with the aim of realizing a low cost compact speech path switch usable in an electronic telephone exchange. One such application of the present invention will next be described with reference to FIGS. 3 to 6, which illustrate one form of integrated electromagnetic switching device including an 8 by 8 contact matrix.

Figure 4:
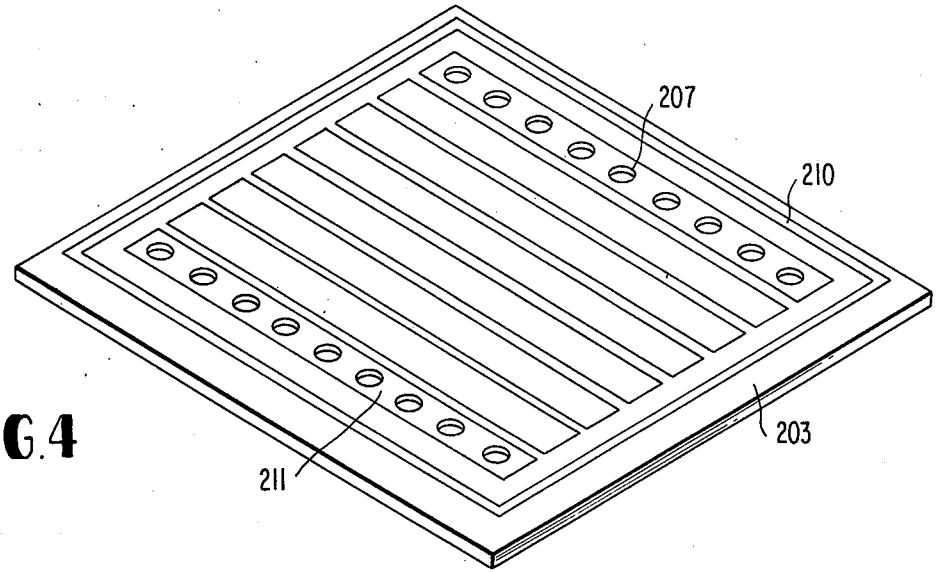

Referring to FIGS. 3 to 6, reference numeral 203 indicates a planar insulating base plate formed with through holes in an 8 × 9 matrix array to define respective contact cells 207. Vapor-deposited on the top surface of the planar base plate 203 are a number eight, of electrically conductive layers 211 which extend along the respective lines of the contact cells 207 and serve as signal lines for moveable contacts, as shown in FIG. 4. The same number of electrically conductive layers 212 are vapor-deposited on the bottom surface of the planar base plate 203 which extend along the respective rows of contact cells 207 as shown in FIG. 5. Of course, the metallized layers 211 in the first group on the one hand, and those 212 in the second group, on the other hand, extend to intersect each other at right angles, but are separated by a distance corresponding to the thickness of the base plate 203. The metallized layers 212 extending in the direction of cell rows are led out through respective terminals 502 as row signal lines (FIG. 5) while the metallized layers 211 extending in the direction of cell lines are connected through the respective contact cells 501 in the ninth row to respective terminals 503 formed on the bottom surface of base plate 203. The contact cells 501 are not only externally metallized as at 504 but also internally thereof forming a through connection as shown in FIG. 6. Also, a metallized layer 210 is formed on the top surface of the base plate 203 around the periphery thereof, as shown in FIG. 4, and a sealing ring, not shown, is brazed to the layer 210.

The planar metallized insulating base plate 203 is formed of ceramic or the like insulating material, for example, in the following manner. First an unbaked tape of such material, of 0.6 to 1.0 mm thickness, is fed to be formed with through holes successively as by punching on a press. The punched tape is cut into sections corresponding in length to the size of the switch unit, and such sections are fed to a metallizing station to have formed thereon the conductive layers in the pattern required. It will be apparent that, such process of preparing metallized base plates can readily be made automatic and is desirable for the reduction in cost of production.

After metallization, sealing strips 202 are brazed to the respective metallized layers 212 extending in the direction of cell rows, as illustrated in FIG. 6. Similarly, spring supports 213 are brazed to the respective metallized layers 211 extending in the direction of the cell lines. In this connection, it is to be noted that both the sealing strips and the spring supports are not furnished as individual pieces but in the form of a patterned sheet for each switching unit, as illustrated in FIG. 7 for the sealing strips. In the patterned sheet shown in FIG. 7, all the sealing strips 202 to be brazed to the respective metallized layers 212 are formed integral with the sheet frame 701 as a beam extending between a pair of opposite side portions thereof and cut apart from the frame to size after being brazed to the respective metallized layer 212. The patterned sheet is preferably formed of a magnetic material with the aim of increasing the effect of magnetic attraction of the core members 201, and the sealing beams of strips 202 are reduced in width, at regular intervals, as shown, in order to minimize magnetic interference between any two adjacent contact cells.

FIG. 8 illustrates an integral resilient sheet patterned to form contact springs, centered at 802, and pairs of spring supporting strips 801, which are connected at the opposite ends with the opposite edge portions of the sheet. As shown, the contact springs are each connected at its diagonally opposite edges with the respective strips 801 in the associated pair through the medium of a pair of triple bent legs to exhibit a gimbal-like operating characteristic. Armatures 208 are fixed to the respective contact springs 802 as by welding, as indicated by the dotted circles in FIG. 8, while spring supports 213 are secured to the respective strips 801 as by welding. As will readily be understood, with this arrangement, the contact springs exhibit an increased stiffness ratio in operation and thus their vibration which occurs when they are restored can attenuate rapidly. The rate of attenuation is further increased by the resistance of air existing between the inner wall of the contact cell 207 and the armature 208, which is housed in the cell with a limited annular space defined therebetween.

FIG. 9 illustrates a modified basic structure of the electromagnetic switch of the present invention, in which contact spring 209 and sealing cover 204 are fixed directly to the respective metallized layers 211 and 210 by welding, thus enabling further reduction in fabrication cost.

FIG. 10 illustrates a further switch structure embodying the present invention, which is basically the same as those previously shown and described and is usable with substantially the same successful results. As observed, in this embodiment, the sealing strip 202 is secured to the base plate 203 on the same side thereof as the moveable contact 205 through the medium of the conductive layer 212, which is extended along the wall of the through hole to that side of the base plate, as shown.

Though, in the embodiments shown and described with reference to FIG. 2, 3, 9 and 10, a hermetically sealed structure is employed, including sealing strip 212 and sealing cover 204, which cooperate to sealingly enclose the switch contacts, it will be readily understood that they may also be employed without sealing means if desired.

As apparent from the foregoing description, all the component parts of the electromagnetic switch assembly according to the present invention are furnished in an integral form and can be fabricated to the required size and shape, for example, by laser means. This means that a multitude of switching elements can be efficiently formed on a batch basis and makes it easy to automate the respective steps of production and substantially reduce cost of fabrication. It is to be appreciated that, according to the present invention, an integrated type electromagnetic switching device can now be realized which is markedly reduced in size as well as in cost compared with conventional forms of electromagnetic switch of the same general character.

What is claimed is:

1. An electromagnetic switch comprising:

an electrically insulating plate having a through hole formed therein;

first and second electroconductive layers formed on opposite surfaces of said insulating plate around said through hole; and an electromagnetic relay including a core member secured to one of said first or second electroconductive layers, a spring member secured to the other of said second or first electroconductive layers, and an armature member attached to said spring member for movement longitudinally within said through hole.

2. An electromagnetic switch as recited in claim 1 wherein said electromagnetic relay further comprises a fixed contact connected to said core member and a moveable contact connected to said armature member.

3. An electromagnetic switch as recited in claim 1 further comprising a sealing plate secured about the periphery of said through hole to said first or second electroconductive layer on one side of said sealing plate and attached to said core member on the other side of said sealing plate, and a cover member hermetically sealed to said insulating plate on the side opposite said core member.

4. An electromagnetic switch as recited in claim 3 further comprising a metalized layer formed about the periphery of said insulating plate on the side opposite said core member, said cover member being attached to said metalized layer.

5. An electromagnetic switch as recited in claim 4 further comprising a support means interposed between said spring member and said other of said second or first electroconductive layers, and a sealing ring interposed between said cover member and said metalized layer.

6. An electromagnetic switch as recited in claim 1 wherein said electromagnetic relay further comprises a fixed contact connected to said core member and a moveable contact connected to said armature member.

7. A switching device comprising a matrix array of electromagnetic switches as recited in claim 1 fabricated on a common insulating plate wherein one of said first or second electroconductive layers are formed as a first group of electrically conductive stripes extending along the respective lines of said through holes on one surface of said insulating plate and the other of said second or first electroconductive layers are formed as a second group of electrically conductive stripes extending along the respective rows of said through holes on the other suface of said insulating plate.

8. An electromagnetic switch comprising:

an electrically insulating plate having a through hole formed therein;

first and second electroconductive layers formed concentrically on the same surface of said insulating plate around said through hole; and an electromagnetic relay including a core member projecting through said through hole and secured to the inner one of said first or second electroconductive layers, a spring member secured to the other of said second or first electroconductive layers, and an armature member attached to said spring member for movement perpendicular to said insulating plate along the axis of said core member.

9. An electromagnetic switch as recited in claim 8 further comprising a sealing plate secured about the periphery of said through hole to said first or second electroconductive layer on one side of said sealing plate and attached to said core member on the other side of said sealing plate, and a cover member hermetically sealed to said insulating plate on the side opposite said core member.

10. An electromagnetic switch as recited in claim 9 further comprising a metalized layer formed about the periphery of said insulating plate on the side opposite said core member, said cover member being attached to said metalized layer.

11. An electromagnetic switch as recited in claim 10 further comprising a support means interposed between said spring member and said other of said second or first electroconductive layers, and a sealing ring interposed between said cover member and said metalized layer.

12. An electromagnetic switch as recited in claim 8 wherein said inner one of said first or second electroconductive layers is plated through said through hole to form an electroconductive layer around said through hole on the opposite side of said insulating plate.

13. A switching device comprising a matrix array of electromagnetic switches as recited in claim 8 fabricated on a common insulating plate wherein one of said first or second electroconductive layers are formed as a first group of electrically conductive stripes extending along the respective lines of said through holes on one surface of said insulating plate and the other of said second or first electroconductive layers are formed as a second group of electrically conductive stripes extending along the respective rows of said through holes on the other surface of said insulating plate.

* * * * *